US005522849A

United States Patent [19]

Xiques et al.

[11] Patent Number: 5,522,849

[45] Date of Patent: Jun. 4, 1996

[54] PACIFIER WITH A CLOTH HANDLE

[76] Inventors: Tony Xiques; Georgia Tracy-Xiques, both of 2645 State St., #Y-4, Santa Barbara, Calif. 93105

[21] Appl. No.: 179,317

[22] Filed: Jan. 10, 1994

[51] Int. Cl.[6] ..... A61J 17/00

[52] U.S. Cl. ..... 606/236; 606/234

[58] Field of Search ..... 2/49.1; 606/234–236; D24/194–198

[56] References Cited

U.S. PATENT DOCUMENTS

| | | | |
|---|---|---|---|
| 3,022,915 | 2/1962 | Mullin | 606/234 |
| 3,392,729 | 7/1968 | Lenoir | 606/234 |
| 4,188,747 | 2/1980 | Kramer | 606/234 |
| 4,204,362 | 5/1980 | Fournier | 46/116 |
| 4,488,551 | 12/1984 | Connelly | 606/236 |
| 4,604,758 | 8/1986 | Grasberger et al. | 2/49 R |
| 4,776,546 | 10/1988 | Goldson | 2/49 R |
| 5,131,096 | 7/1992 | Olson | 2/75 |
| 5,147,384 | 9/1992 | La Rocca | 606/236 |
| 5,156,617 | 10/1992 | Reid | 606/234 |
| 5,201,073 | 4/1993 | Spanier | 2/49 R |
| 5,344,355 | 9/1994 | Silverstein | 606/234 |
| 5,391,184 | 2/1995 | Rosenthal | 606/234 |

*Primary Examiner*—Stephen C. Pellegrino
*Assistant Examiner*—Glenn Dawson
*Attorney, Agent, or Firm*—Leo F. Costello

[57] ABSTRACT

A pacifier clamped to a cloth handle by two interconnected members, one on each side of the cloth.

12 Claims, 1 Drawing Sheet

PACIFIER WITH A CLOTH HANDLE

FIELD OF INVENTION

This invention relates to pacifiers for small children, i.e., rubber nipples resembling the standard nipples on baby bottles which young children to chew upon for enjoyment.

BACKGROUND OF INVENTION

Most pacifiers consist of a nipple and some type of support assembly such as a plastic handle which both provides the child with a means to grasp the nipple and prevents the child from swallowing the nipple.

Nipples are fabricated of some type of non-porous, rubbery material such as latex upon which the child can safely chew.

SUMMARY OF INVENTION

Figure 1:
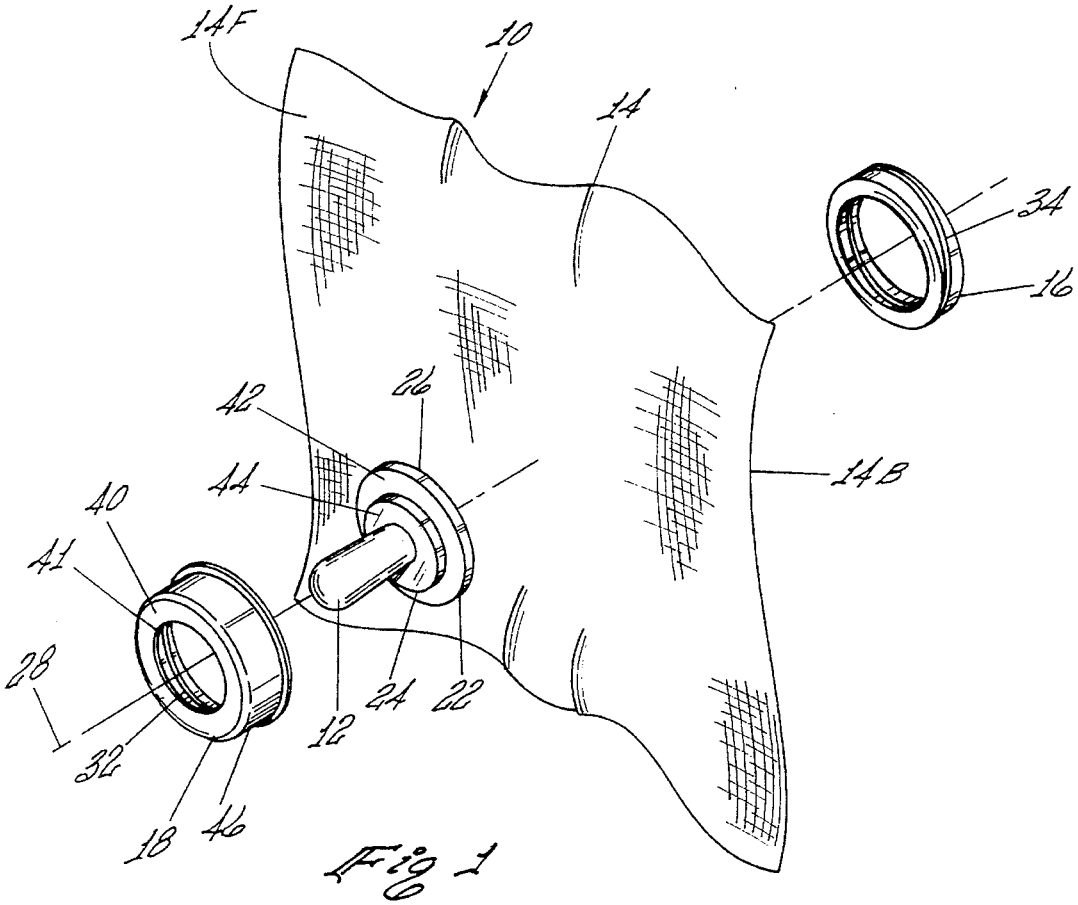
FIG. 1 is an exploded isometric view of the pacifier device of the present invention, which is drawn in full scale, except that the cloth blanket is not to scale, showing how the threaded male retainer ring is threadable into the female cap to support both the nipple and the cloth blanket.
Figure 2:
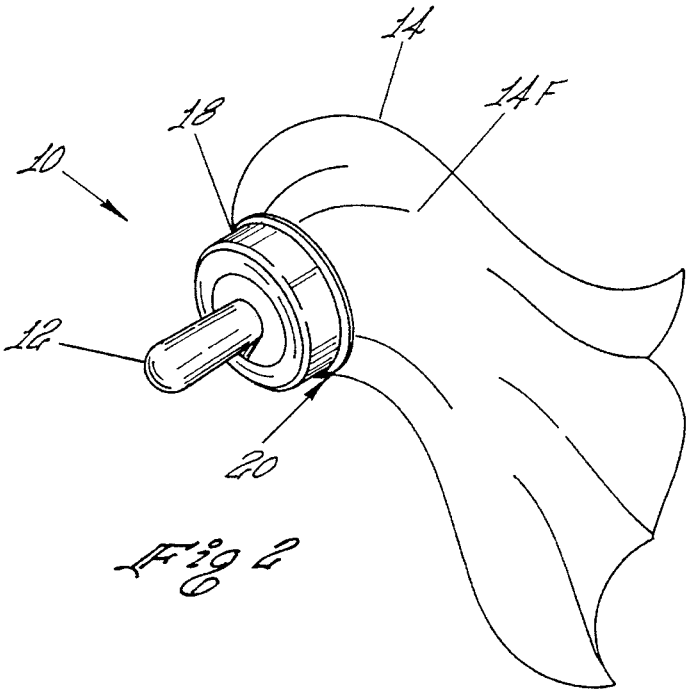

The invention is shown in FIG. 1 and 2. The invention consists of a specially manufactured pacifier nipple attached to a soft, towel like cloth. The cloth in this invention serves the same purpose as the plastic handle assembly of the typical pacifier 1, i.e., it provides the child with a convenient means to grasp the nipple and it prevents the child from swallowing the nipple.

DESCRIPTION OF THE PREFERRED EMBODIMENT

A child's pacifier device in accordance with the present invention is identified in FIGS. 1 and 2 by the numeral 10 and includes a nipple 12 attached to a cloth blanket 14. The exploded view presented in FIG. 1 shows how both the blanket and the nipple are clamped in place by threading the male retaining ring into the female cap. Both the threaded retaining ring 16 and the cap 18 are fabricated of a resilient, non-toxic plastic. The nipple is solid silicon rubber. The cloth blankets come in various styles and colors. Blankets are interchangeable and a new blanket may be installed while the original blanket is being cleaned.

The nipple 12 is part of a solid nipple assembly 20 with a disc-shaped base 22 fabricated, such that said disc-shaped base is attached to the mounting end 24 of the nipple, and with the flat surface 26 of the disc-shaped base perpendicular to the longitudinal axis 28 of the nipple, such that said nipple assembly may be secured in place by clamping to the disc-shaped base.

The nipple assembly 20 with the disc-shaped base 22 is secured to the cloth blanket 14 by the threaded female cap 18 having internal threads 32 and the threaded male retaining ring 16 having external threads 34, the former being similar to the threaded female cap used to secure a nipple to a standard baby bottle assembly and the latter resembling the threaded portion of the bottle of a standard baby bottle assembly.

The blanket or cloth 14 has front and back surfaces or sides 14F and 14B. The cap 18 has a front annular shoulder 40 circumscribing an opening 41, and the base 22 has an annular outer rim 42 surrounding 8 a raised inner ridge 44 which extends forwardly toward the sucking end of the nipple 12. As shown in FIG. 1, the outer diameter of the ridge 44 is approximately equal to the inner diameter of the opening 41, and the axial lengths of the ridge 44 and the shoulder 40 are approximately equal. When the nipple and the base are brought together in the assembly 20, the ridge fits snugly within the opening by the shoulder, the shoulder mates against the rim, and the front surface of the ridge is flush with the front surface of the shoulder. Also, the cap has a skirt 46 which is of substantially the same length as the length of the ring 16 so that the ring fits substantially completely within the cap when the ring is fully threaded into the cap.

What is claimed is:

1. A child's pacifier device, comprising a cloth having opposite sides, a nipple, a base on the nipple, said base being positioned on one side of the cloth, first clamping means positioned on said one side of the cloth adjacent to the base, and second clamping means positioned on said other side of the cloth in opposed relation to said first clamping means and said base, said base and cloth being thereby between the first and second clamping means, said first and second clamping means being operable to apply force which draws the first and second clamping means toward each other with the base and the cloth therebetween so as to press the base and the cloth tightly together and also being operable to release such force to enable the base and the cloth to be separated, whereby when the first and second clamping means clamp the base and the cloth together, the nipple is secured to the cloth and projects outwardly therefrom and whereby the cloth is extendible outwardly from the nipple, said cloth preventing the child from swallowing the nipple, being foldable to enable the child to grasp it and hold the nipple thereby, and being unfoldable to wipe the child's face.

2. The pacifier device of claim 1, wherein said first and second clamping means are capable of clamping the base and the cloth together at selectively different positions on the cloth.

3. The pacifier device of claim 1, wherein at least said second clamping means must be manipulated to release the nipple from the cloth.

4. The pacifier device of claim 1, wherein said first and second clamping means include first and second elements separate from the cloth and located on both sides of the cloth for releasably clamping the cloth therebetween, said first and second clamping means requiring that they both be manipulated to enable release of the nipple from the cloth.

5. A child's pacifier device, comprising a cloth having opposite sides, a nipple, and means for releasably clamping the nipple to the cloth so that the nipple projects outwardly from one side of the cloth and the cloth is extendible outwardly from the nipple, said cloth preventing the child from swallowing the nipple, being foldable to enable the child to grasp it and hold the nipple thereby, and being unfoldable to wipe the child's face, wherein said means includes female and male connectors releasably interconnected through the cloth whereby the cloth is gripped between said connectors attaching the nipple to the cloth.

6. A child's pacifier device, comprising a cloth having opposite sides, a nipple means for releasably clamping the nipple to the cloth so that the nipple projects outwardly from one side of the cloth and the cloth is extendible outwardly from the nipple, said cloth preventing the child from swallowing the nipple, being foldable to enable the child to grasp it and hold the nipple thereby, and being unfoldable to wipe the child's face, said means including a base attached to the nipple having a flat surface disposed toward said one side of the cloth and an opposite surface facing away from the cloth, a first retainer member fitted around the nipple having a flat inner shoulder in mating engagement against said opposite surface of the base, and a second retainer member against said other side of the cloth in alignment with the first retainer member, said retainer members having threads releasably interconnected through the cloth.

7. A child's pacifier device, comprising:

a single, relatively thin, layer of cloth having relatively smooth opposite surfaces, one of said surfaces facing in one direction and the other surface facing in the opposite direction when the cloth is stretched out in flat condition, a pacifier including a nipple and a substantially flat base extending radially from the nipple and being positioned against and in contact with one of the surfaces of the cloth, and clamping means including clamping members which can be entirely separated from each other but which interact to engage opposite surfaces of the cloth in opposed relation to each other and to the base for releasably engaging and clamping the base to the cloth without penetrating the cloth, said base and clamping means cooperating to enable clamping of the base to the cloth at selectively different locations on the cloth with the nipple supported by the cloth and projecting outwardly from said one surface of the cloth.

8. A child's pacifier device, comprising:

a nipple having oppositely extending mounting and sucking ends and a longitudinal axis, a disc-shaped base attached to said mounting end and having a from surface facing toward the sucking end and a substantially flat rear surface extending radially of said axis and facing away from said sucking end, a cloth having one side facing and overlaying said rear surface of the base and an opposite side facing away from the base, an annular cap fitted around the nipple having an internal shoulder bearing against the front surface of the base, and a retainer bearing against said opposite side of the cloth in alignment with the base, said cap and retainer having portions interconnected to each other through the cloth so as to releasably interconnect the cap and the retainer thereby to clamp the cloth therebetween and to clamp the base to the cap, whereby the sucking end of the nipple projects outwardly from the cloth.

9. The pacifier device of claim 8, wherein the cap is an internally threaded female cap, and wherein the retainer is an externally threaded male retainer, said retainer being threadable into the cap.

10. The pacifier device of claim 9, wherein the cap has an annular skirt extending axially from the shoulder away from said sucking end, wherein said retainer is a ring having substantially the same axial dimension as the skirt, said threads being substantially completely on the inside of the skirt and on the outside of the ring, said ring being thereby capable of being threaded into the skirt.

11. The pacifier of claim 9, wherein said shoulder is annular and defines an axial opening in the cap, wherein said front surface has an outer rim engaging the shoulder and an inner ridge fitted within said opening and engaging the shoulder, thereby stabilizing the position of the nipple within the cap.

12. The pacifier device of claim 8, wherein said nipple, base, cap and retainer are made of plastic.

* * * * *